US012729499B2

(12) United States Patent
Matheson et al.

(10) Patent No.: US 12,729,499 B2
(45) Date of Patent: Sep. 8, 2026

(54) PIPE TRENCH SAFETY BRACE-BARRIER SYSTEM AND METHOD

(71) Applicants: Cole Matheson, Stephenville, TX (US); Kale Comeaux, St. Francisville, LA (US)

(72) Inventors: Cole Matheson, Stephenville, TX (US); Kale Comeaux, St. Francisville, LA (US)

( * ) Notice: Subject to any disclaimer, the term of this patent is extended or adjusted under 35 U.S.C. 154(b) by 59 days.

(21) Appl. No.: 19/039,453

(22) Filed: Jan. 28, 2025

(65) Prior Publication Data

US 2026/0218472 A1 Jul. 30, 2026

(51) Int. Cl.
*E02D 17/08* (2006.01)

(52) U.S. Cl.
CPC ..... *E02D 17/08* (2013.01)

(58) Field of Classification Search
CPC ..... E02D 17/08
See application file for complete search history.

(56) References Cited

U.S. PATENT DOCUMENTS

| | | | | |
|---|---|---|---|---|
| 2,777,294 | A | 1/1957 | Rosa et al. | |
| 3,606,757 | A | 9/1971 | De Weese et al. | |
| 4,056,940 | A | 11/1977 | Fisher | |
| 4,114,383 | A | 9/1978 | Nieber | |
| 4,310,267 | A | 1/1982 | Davis | |
| 4,685,837 | A | 8/1987 | Cicanese | |
| 5,310,290 | A | 5/1994 | Spencer | |
| 6,164,875 | A * | 12/2000 | Wu | E02D 17/08 405/282 |
| 11,021,847 | B2 | 6/2021 | Burleson | |
| 2022/0275595 | A1 * | 9/2022 | Molyneux | E02D 17/083 |

FOREIGN PATENT DOCUMENTS

| | | | | |
|---|---|---|---|---|
| KR | 102749558 | B1 * | 1/2025 | E03F 3/06 |

* cited by examiner

*Primary Examiner* — Kyle Armstrong
(74) *Attorney, Agent, or Firm* — KEATY LAW FIRM LLC; Thomas S. Keaty

(57) ABSTRACT

A pipe trench safety brace-barrier system and method for use to form a protected workspace in a trench, providing trench-shoring or trench-shielding protection around an underground workspace in a portion of a trench within which a pipe, conduit, cable, or similar structure, and any manhole, junction box, or similar structure or equipment is to be installed. The pipe trench safety brace-barrier provides two trench side units, each having a main wall unit and two wing wall units. The main wall units are placed against opposing sides of the workspace, providing barriers against cave-ins or encroachment from the sides of the wider section of trench. In use, the wing wall units are angled inward toward the pipe, providing barriers against cave-ins or encroachment from the entering and exiting portions of the trench adjacent to the workspace. Optional adjustable wing extensions on the wing wall units are moved into place to support and limit movement of the pipes. One or more adjustable main transverse members are adjustably and removably mounted to the opposing main wall units to provide bracing and stability. Optionally, additional supplemental braces, barriers, fittings, or equipment can be mounted upon the frame members of the trench side units. The trench side units can be folded or collapsed to a reduced size for storage, transportation, and handling.

19 Claims, 14 Drawing Sheets

PIPE TRENCH SAFETY BRACE-BARRIER SYSTEM AND METHOD

BACKGROUND OF THE INVENTION

This invention provides a pipe trench safety brace-barrier system and method for use to form a protected workspace in a trench, providing trench-shoring or trench-shielding protection around an underground workspace in a portion of a trench within which a pipe, conduit, cable, or similar structure, and any manhole, junction box, or similar structure or equipment is to be installed.

In construction activities involving the laying or running of pipe, conduit, cables, or similar structures, the pipe is run in a trench dug in the ground, with the pipe being covered over after installation. For later repair, replacement, or modification to the pipe, or the running of additional pipe, conduit, or cables, the trench might be re-opened or partially re-opened. Often it is necessary for workers to enter the trench to perform installation, joining, inspection, and repair operations on the pipe. Such operations might need to be performed at any location along the run of pipe, regardless of the locations of joints, junctions, or manholes. Workers inside a trench need to be protected from cave-ins and other movements of earth within the trench, and also need to be protected from movements of the pipe itself, which can be caused by cave-ins or movements of earth up and down the trench, or by movement of the connected pipe by other teams of workers up and down the trench.

Sections of pipe being installed, joined, or repaired should be able to be moved a small amount within the trench to allow for adjustments and alignment, but larger movement should be prevented because of the risk of injury to workers and damage to the pipe and to equipment. Usually, the pipe should be constrained to the center of the trench with only a small amount of movement allowed.

When installing underground pipes or similar conduit or cables, manholes, junction boxes, or similar structures or equipment are normally installed at intervals along the underground run of pipe. The pipe is installed in an excavated trench, and the trench is usually made to be wider at locations meant to accommodate manholes. Whether the manhole structure is built in place or is pre-built and lowered into place there is normally a need for a workspace around the manhole within which workers can build or place the manhole structure and connect the entering and exiting pipes. Such a workspace must be protected against collapse or cave-ins of the walls of the trench. Trench shoring or trench shielding is used to protect workers within the trench. As the terms are generally understood, trench shoring aims to prevent any collapse or cave-in from occurring, while trench shielding aims to protect workers from any collapse or cave-in which may occur. Both shoring and shielding require providing a barrier against collapse or cave-in of the trench walls.

On a construction site the operation of heavy machinery and other activity close to the sides of the trench can cause collapse or cave-ins and other encroachments of dirt or debris into the workspace in the trench. Also, where other workers or machinery are operating on or otherwise moving other sections of the pipe outside the workspace, such remote movement can both dislodge dirt and debris and can dislodge or place strain on the pipe and interfere with the connection of the pipe to the manhole structure.

Use of a trench shield in the US is governed by OSHA 29 CFR Part 1926.650-.652 Subpart P-Excavations.

Many existing trench shoring and trench shielding devices require the use of separate larger, wider units to provide protected space for workers installing a manhole, junction, or other large equipment or structures along a pipe, and do not provide adequately for protection of the gaps between the different units of normal trench width and wider sections. Many existing devices do not provide an adequate barrier against dirt or debris encroaching from the area along the main trench, around the pipes. For example, a separate work crew might be backfilling the main trench to cover the pipe, and such fill dirt might collapse along the trench and into the workspace around the manhole. Such backfilling and other activities such as workers standing on the pipe or otherwise moving the pipe can cause the end of the pipe at the manhole to move either out of alignment with the manhole or to move or apply strain to the manhole, and such movement might injure workers or might prevent a proper joint from being made or might loosen an inadequately cured joint. Many existing devices to not provide for adequate bracing and fixing of the pipe in place where the pipes enter and exit the workspace around the manhole installation.

Trench shoring or shielding devices should provide protection against dirt, vegetation, or debris being disengaged and tumbling into the trench, possibly injuring workers or affecting operations, as might happen if a tractor or vehicle were operated close to the edge of the trench.

U.S. Pat. No. 11,021,847 for a "Bell Hole Box," issued on Jun. 1, 2021 to assignee Quanta Associates, L.P., provides for a bell hole box with an open bottom for protecting construction workers from wall cave-in when working below a surface of the Earth, where the box may utilize two, opposing, generally concave walls with generally straight panels portions. The two walls may be connected using multiple spreaders that are pinned or connected to each of the two opposing walls. Each longitudinal end of the bell hole box is open to permit passage of a pipeline through it. Numerous vertical guard posts may be connected around a top frame rail and joined together with chains. The bell hole box may be lifted in and out of a hole with mounted lifting hooks.

U.S. Pat. No. 4,114,383 for a "Portal Frame for Trench Box Stack," issued on Sep. 19, 1978 to assignee Efficiency Production, Inc., provides for a portal frame attached to the open end of a trench box structure and assembling and rigidifying the stacked plural boxes forming the smooth wall sides of the consequent trench box whereby side sections or panels of trench boxes are stackably adjustable as to depth or trench served and the portal span provides maximum clearance for the pipe and including thrust plates in the portal frame for transmitting thrust from the boxes and into the portal frame.

U.S. Pat. No. 4,310,267 for a "Safety Trench Box," issued on Jan. 12, 1982 to inventor Clinton Davis, provides for a safety trench box for use in protecting workmen from cave-ins while operating within an excavated area. The device includes a barrier which surrounds the work area having a depth substantially that of the trench and an opening along one wall of the barrier that allows work to be sequentially fed therethrough. The safety device includes a pair of runners upon which the device is carried so that advancing the safety device can be easily accomplished.

U.S. Pat. No. 4,056,940 for a "Trench Box Height Adaptor," issued on Nov. 8, 1977 to assignee Griswold Machine & Engineering, Inc., provides for a trench shoring assembly including first and second spaced walls having upper surfaces with third and fourth spaced walls stacked upon the upper surfaces of the first and second walls. A plurality of tubular collars project from the various walls and are aligned vertically at each end thereof. Spreader pipes interconnect these collar projections at one end of the assembly and a spreader assembly interconnects the stacked walls at the other end. More specifically, the spreader assembly includes vertically extending metal beams interconnecting the collars projecting from the walls and tie bars extending between the vertical beams at a position spaced well above the upper surfaces of the lower walls thereby facilitating a pipe having a diameter which is greater than the vertical height of the lowermost walls. In the first embodiment the tie bars are adjustable to vary the spacing between the spaced walls, whereas in the second embodiment they are not adjustable and a plate is secured thereto and depends therefrom and includes an arcuate cutout for surrounding the pipe or conduit.

U.S. Pat. No. 5,310,290 for a "Protective Structure for Excavations," issued on May 10, 1994 to inventor Dennis I. Spencer, provides for a protective panel used alone or paired to form a protective structure to provide a protected space in an excavation by buttressing the upright walls of the excavation. The protective panel is constructed of a corrugated aluminum sheet that has alternating, oppositely opening, longitudinal channels. The end edges and the lateral edges of the sheet are rigidified respectively by a transverse and longitudinal rigidifying members. Mounting stations are located on one side of the protective panel and are formed by transverse support plates that extend across the top of a selected channel and that are reinforced by gusset webs to create a beam section. A brace assembly may mount to the mounting station and may support the protective panel against an upright excavation wall; preferably, however, a pair of opposed protective panels are interconnected and retained apart by a plurality of spreader beams extending between opposed mounting stations to create a protective structure in the form of a trench box. The protective structure may be supported by leg members that telescope into the transverse rigidifying members. Alternatively, the protective structure may be suspended from a wheeled carriage. A plurality of protective structures may be stacked and retained by interconnect pins. The protective panels may include inwardly oriented handles. An optional end panel with a specially configured latch structure is disclosed, and optional mounting stations and spreader beams are described.

U.S. Pat. No. 4,685,837 for a "Portable Safety Trench and Pit Form System," issued on Aug. 11, 1987 to inventor William C. Cicanese, provides for a multi-sided portable trench and pit form system having at least two panels forming each side, each panel releasably interconnectable along the vertical margins of each adjacent panel and side. Elongated rigid braces are also provided which releasably interconnect to and against the sides and spanning the interconnected panels to rigidize the sides. Additionally, the elongated braces also interconnect at their ends to rigidize the preselected relative angular positioning of the sides one to another. The entire assembly forms a barrier or perimeter wall as required within which a user may safely function when working below ground level. An opening may be provided in one panel or between adjacent panels forming a side and having a slideable closure panel to provide working access outside of the enclosure. This modular system is adaptable to variation in the number of sides required, as well as variation in both side width and height.

U.S. Pat. No. 2,777,294 for a "Method of Laying Pipe," issued on Jan. 15, 1957 to inventor James M. Rosa et al., provides for a method and means for simplifying the laying of pipe in a trench formed in wet, loose soil, and particularly to the laying of pipe below the ground water level in such a trench, whereby wood sheathing can be eliminated and the sides of the trench prevented from being acted upon by the water to undermine the support for adjacent water and gas main, by providing a box frame unit of steel which is adapted to be inserted into the trench, preferably at the time the water level is reached and to be driven into place to support the sides of the trench while the dirt within the unit is removed until the grade level is reached. Preferably, the sides of the trench adjacent the unit are backfilled so as to provide adequate lateral support for the soil under the adjacent mains.

U.S. Pat. No. 3,606,757 for a "Method of Laying Pipe," issued on Sep. 21, 1971 to inventors Lloyd De Weese et al., provides for a method for laying large diameter concrete pipe in an excavation of minimum width with maximum safety provided for the personnel laying the pipe, including the steps of digging a partial trench, inserting an excavating cage therein, completing the ditch and lowering sliding individual cantilevered shear members to reinforce the side walls of the trench, laying the pipe and digging an adjacent partial trench, raising the shear members and advancing the cage into the adjacent partial trench and then repeating the cycle. The excavating cage is a rigid frame having a large unobstructed center to permit completion of the excavation therein with a backhoe. The vertically slidable shear members are rigidly supported in guide slots and are capable of withstanding the substantial pressures in their extended position without being cross braced, and a rear shield is provided to permit back filling of the excavation.

SUMMARY OF THE INVENTION

This invention provides a pipe trench safety brace-barrier system and method for use to form a protected workspace in a trench, providing trench-shoring or trench-shielding protection around an underground workspace in a portion of a trench within which a pipe, conduit, cable, or similar structure, and any manhole, junction box, or similar structure or equipment is to be installed. The pipe trench safety brace-barrier provides two trench side units, each having a main wall unit and two wing wall units. The main wall units are placed against opposing sides of the workspace, providing barriers against cave-ins or encroachment from the sides of the wider section of trench. In use, the wing wall units are angled inward toward the pipe, providing barriers against cave-ins or encroachment from the entering and exiting portions of the trench adjacent to the workspace. Optional adjustable wing extensions on the wing wall units are moved into place to support and limit movement of the pipes. One or more adjustable main transverse members are adjustably and removably mounted to the opposing main wall units to provide bracing and stability. Optionally, additional supplemental braces, barriers, fittings, or equipment can be mounted upon the frame members of the trench side units. The trench side units can be folded or collapsed to a reduced size for storage, transportation, and handling.

BRIEF DESCRIPTION OF THE DRAWINGS

Reference will now be made to the drawings, wherein like parts are designated by like numerals, and wherein.

DETAILED DESCRIPTION OF THE INVENTION

Figure 1:
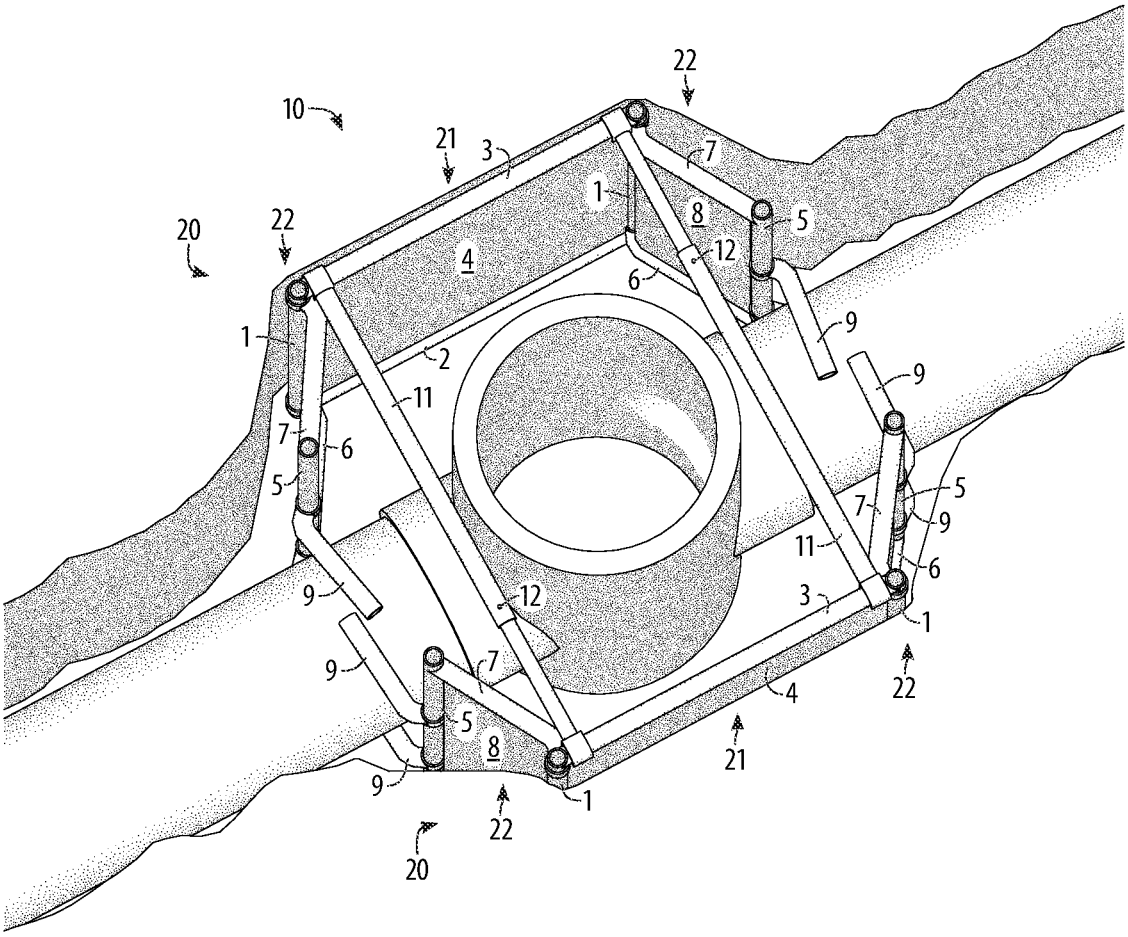
FIG. 1 is a perspective view of a folding embodiment of the pipe trench safety brace-barrier of the invention in use within a trench with a manhole and sections of large pipe.

The pipe trench safety brace-barrier 10 system and method provides for trench-shoring or trench-shielding protection around an underground workspace in a trench, usually with a pipe, conduit, cable, or similar structure, including a trench having a plain section of pipe, possibly needing repairs or adjustment, or a joint between pipes, or a wider section of a trench within which a manhole, junction box, or similar structure or equipment is to be installed on pipes or similar conduit or cables running in sections of trench running into and out of the workspace. A manhole structure might be pre-formed and lowered into place, or might be completely or partially built in place. Usually, workers will have to enter the workspace to build, assemble, or place the manhole unit, and to join the entering and exiting pipe to the manhole unit. Such activity around pipe sections, joints, manholes, and junctions requires a safe workspace protected from cave-ins and other encroachment of dirt or debris, both from the sides or walls of the workspace portion of the trench, and from along the portions of the trench adjacent to the workspace. Also, it is beneficial to brace or support the ends of the pipe near where the pipe meets any joint, manhole, or junction, to prevent the pipe being moved due to activity of others outside the workspace.

Two major embodiments of the pipe trench safety brace-barrier 10 are disclosed and treated here. A folding embodiment provides folding trench side units 20, and a non-folding embodiment provides non-folding trench side units 30, as treated in detail below. Both embodiments are suitable for use with straight sections of pipe and with joints, junctions, manholes, and similar structures and equipment. The illustration of one embodiment in use on straight pipe and another embodiment in use on a manhole is done to avoid duplication of disclosure, and is not meant to indicate that either embodiment is restricted to the illustrated use.

The pipe trench safety brace-barrier 10 can be made of steel, using pipes, tubes, beams, bars, or rods for the frame members, and sheet or plate steel for the barriers, as known in the art and in accord with relevant regulations. The illustrated embodiments of the pipe trench safety brace-barrier 10 have a height of 6 feet and widths of 4 feet for the main wall units 21, 31 and approximately 2 feet for the wing wall units 22, 32, as treated in detail below for the folding embodiment. The folding embodiment is shown surrounding a manhole unit having a 3-foot diameter. The illustrated folding embodiment provides somewhat more than 1 foot of workspace around the manhole. The pipe trench safety brace-barrier 10 is shown in use as extending at least several inches above the ground level, which helps prevent dirt or debris from spilling over the top. The pipe trench safety brace-barrier 10 can be made with smaller or larger dimensions of width or height as needed to provide for different areas of workspace or different depths of trenches.

Figure 2:
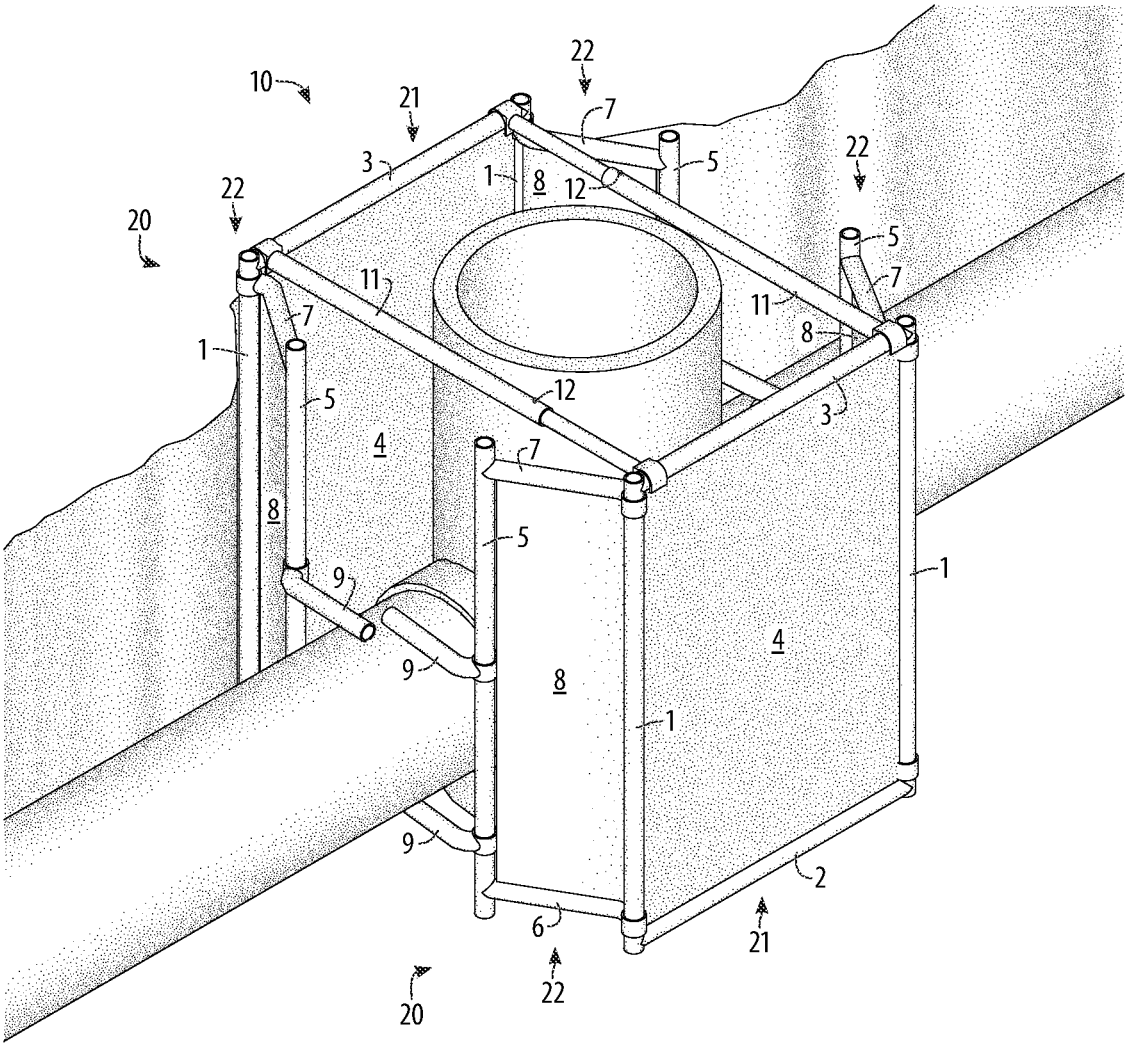
FIG. 2 is a perspective view of a folding embodiment of the pipe trench safety brace-barrier of the invention in use within a trench.
Figure 3:
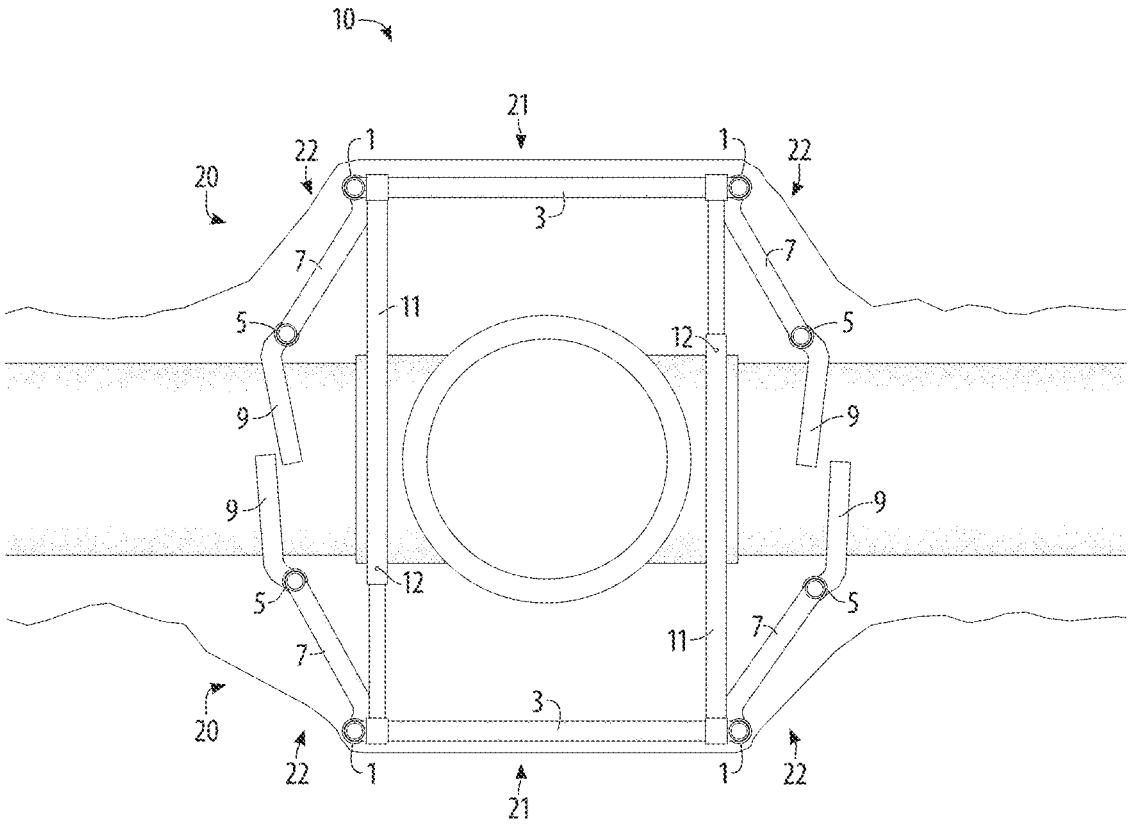
FIG. 3 is an overhead view of a folding embodiment of the pipe trench safety brace-barrier of the invention in use within a trench.

Referring to FIG. 1, FIG. 2, and FIG. 3, the folding embodiment of the pipe trench safety brace-barrier 10 provides two folding trench side units 20 placed, in use, opposite each other and against the walls of the workspace section of the trench, as shown. Each folding trench side unit 20 provides a main wall folding unit 21 providing two main vertical frame members 1 running vertically from the bottom toward the top of the trench. Between the two main vertical frame members 1 are permanently horizontally mounted at the bottom a lower main frame member 2 and at the top an upper main frame member 3, forming a rectangle. A main barrier 4 is mounted securely to the main vertical frame members 1, lower frame member 2, and upper main frame member 3, forming a rectangular main wall folding unit 21 capable of blocking the movement of dirt or debris. Two wing wall folding units 22 are provided. Each wing wall folding unit 22 is rotatably mounted to a different main vertical frame member 1 of the main wall folding unit 21 such that the wing wall folding unit 22 can be rotated about the vertical axis of the main vertical frame member 1. Each wing wall folding unit 22 provides a lower wing frame member 6 and an upper wing frame member 7, both rotatably mounted to a main vertical frame member 1, and both running horizontally. A vertical wing frame member 5 is permanently mounted at the bottom to the lower wing frame member 6 and at the top to an upper wing frame member 7, forming a rectangle. A wing barrier 8 is mounted securely to the vertical wing frame member 5, lower wing frame member 6, and upper wing frame member 7, forming a rectangular wing wall folding unit 22 capable of blocking the movement of dirt or debris, which can be rotated about the vertical axis of the main vertical frame member 1.

Optionally, and as needed, adjustable wing extensions 9 are mounted to vertical wing frame members 5 such that each adjustable wing extension 9 can be independently rotated about the vertical axis of the vertical wing frame member 5, can be independently moved up and down the vertical wing frame member 5, and can be securely temporarily fixed in position on the vertical wing frame member 5 by known means such as a clamp, screw, bolt, or toggle.

Optionally, several adjustable wing extensions 9 can be provided, and can be attached as needed as additional adjustable wing extensions. In a preferred embodiment the rotational position of the rectangular wing wall folding unit 22 about the main vertical frame member 1 can also be securely temporarily fixed in position on the main vertical frame member 1 by such known means as clamps, screws, bolts, or toggles, in order to further increase the stability of the structure in use.

In use, the two folding trench side units 20 are placed opposite each other, at or near the walls of the section of trench which has been excavated to create the workspace for work on the pipe or manhole. Each rectangular wing wall folding unit 22 is rotated about its main vertical frame member 1 to move its vertical wing frame member 5 toward the pipe and toward the central area of the trench, bringing the vertical wing frame member 5 close to or in contact with the pipe. The adjustable wing extensions 9 are rotated about and are moved up and down the vertical wing frame member 5 and are securely temporarily fixed in position on the vertical wing frame member 5. The adjustable wing extensions 9 are positioned to allow the entry of the pipe into the workspace, and preferably to both support the pipe in the proper position for joining to the manhole unit, and to prevent the pipe being moved out of position by forces exerted on the pipe outside of the workspace. Maximum support of the pipe can be achieved when the vertical wing frame members 5 are in contact with the pipe, bracing against lateral movement, and the adjustable wing extensions 9 are in contact with opposite portions of the pipe, bracing against upward or downward movement. At least one adjustable main transverse member 11 is securely removably mounted between both of the upper main frame members 3 to prevent any tilting of the upper portions of the folding trench side units 20 toward each other. The use of two adjustable main transverse members 11 is illustrated. At least one fastener 12, such as a bolt or a t-handled bolt, or a clamp, screw, or toggle, is provided for each adjustable main transverse member 11 to allow the adjusted length to be securely fixed during use and to be collapsed for storage and re-extended for subsequent use. Generally, the lowest portions of the folding trench side units 20 will be in contact with, and possibly slightly sunk into the ground at the bottom of the workspace, providing sufficient stability and resistance to movement. Where needed, the bottom portions of the main wall folding units 21 can also be braced with adjustable main transverse members 11 or by other methods such as driving stakes into the ground. Also, when the wing wall folding units 22 are rotated inward toward the perpendicular they provide additional bracing against tilting or movement of the folding trench side unit 20. Further optional supplemental bracing is treated below.

Figure 4:
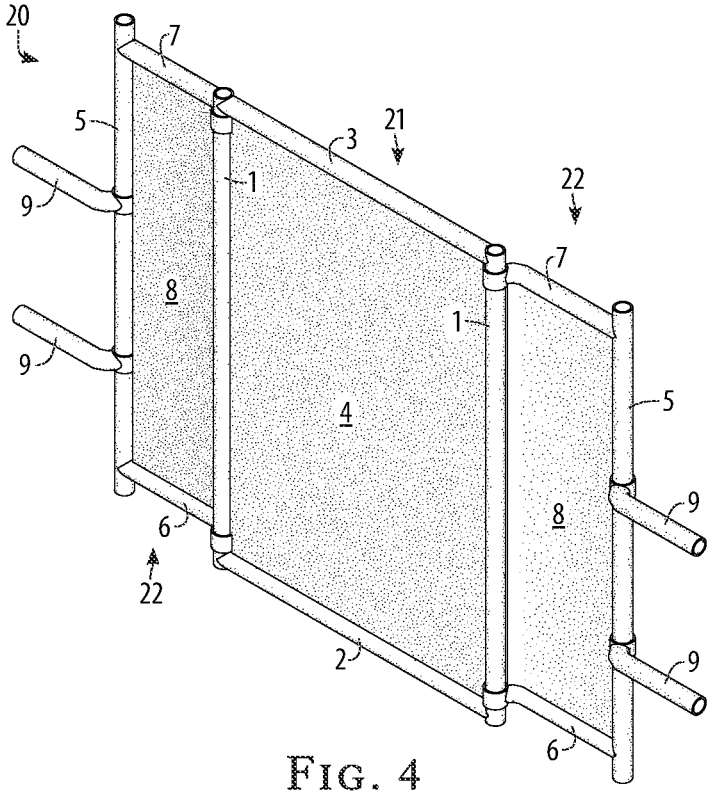
FIG. 4 is a perspective view of one wall unit of a folding embodiment of the pipe trench safety brace-barrier of the invention with wings extended.
Figure 5:
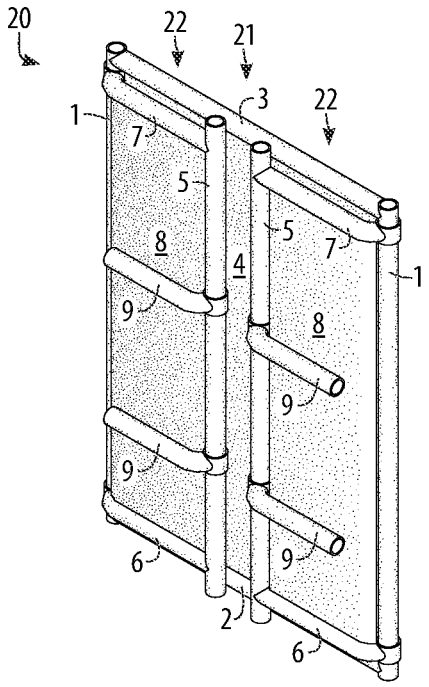
FIG. 5 is a perspective view of one trench side unit of a folding embodiment of the pipe trench safety brace-barrier of the invention with wings folded.

Referring to FIG. 4 and FIG. 5, in the illustrated folding embodiment, the lower wing frame members 6 and upper wing frame members 7 are rotatably mounted on the main vertical frame members 1 with an offset or dogleg, as shown, allowing each wing wall folding unit 22 to be rotated substantially 180 degrees and to lie substantially flat against the main wall folding unit 21. The adjustable wing extensions 9 are rotatably mounted on the vertical wing frame members 5 with a similar but opposite offset, allowing the extensions to be similarly rotated substantially 180 degrees and to lie substantially flat against the wing wall folding unit 22. As illustrated, particularly in FIG. 3 top or plan view, the optimum amount of offset is substantially the front-to-back depth of the upper and lower main frame members 2, 3. For example, where 2.5-inch outside-diameter steel pipe or tubing is used for the frame members an offset of substantially 2.5 inches is used. It is not necessary to offset the adjustable wing extensions 9 to the full amount necessary for the wing frame members 2, 3 because the adjustable wing extensions 9 do not need to fold against any frame members. When the substantially 180-degree rotations are made the folding trench side unit 20 is effectively folded down to the width of the main wall folding unit 21, which is a reduced size of not much more than half of the effective width of the folding trench side unit 20 when extended. The provision for such folding is advantageous for storage, transportation, and handling. The trench side units 20 can be stored in spaces having a longer dimension of only the width of the main wall folding unit 21, can be transported on smaller vehicles such as a pickup truck or smaller cargo van, and during handling will not be subject to the same leverage and balance issues as the fully or partially extended units.

Figure 6:
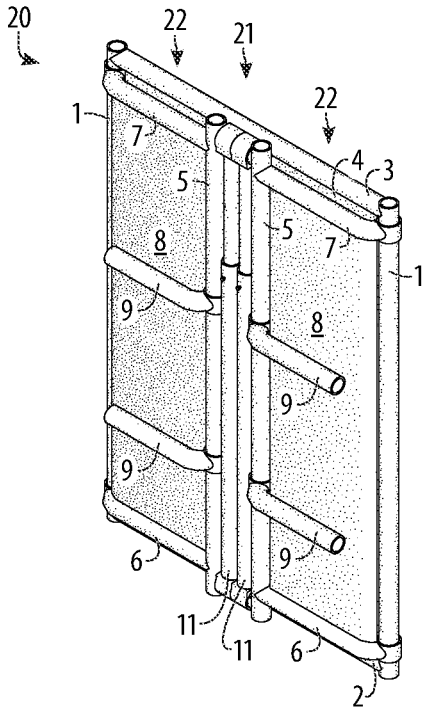
FIG. 6 is a perspective view of one trench side unit of a folding embodiment of the pipe trench safety brace-barrier of the invention with wings folded and with adjustable main transverse members fitted for transport and storage.

Referring additionally to FIG. 6, the illustrated embodiment provides wing wall units 22 having widths of less than half of the width of the main wall folding unit 21. In the illustrated example the width of the wing wall units 22 is approximately 45% of the width of the main wall folding unit 21. When the unit is folded an empty space is left between the vertical wing frame members 5. This empty space can accommodate other equipment such as the two adjustable main transverse members 11 shown, providing for the folding trench side unit 20 and the other equipment to be stored, transported, and handled together.

Figure 7:
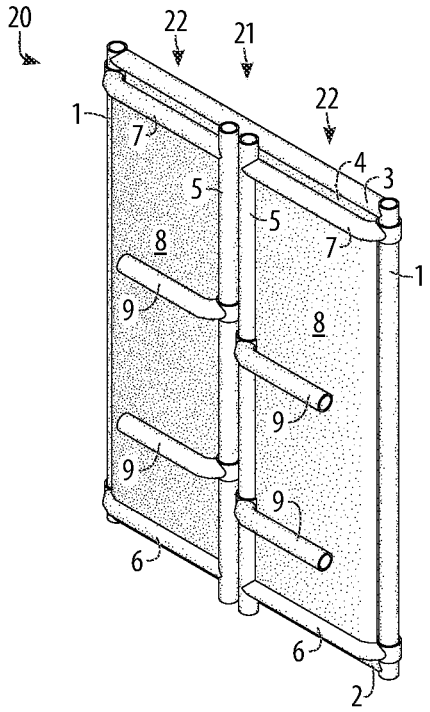
FIG. 7 is a perspective view of another embodiment of one trench side unit of a folding embodiment of the pipe trench safety brace-barrier of the invention, having wider wings, with wings folded.

Referring additionally to FIG. 7, for most uses the width of the wing wall units 22 will not need to be fully half of the width of the main wall folding unit 21 because some kind of gap for entering or exiting pipes will need to be provided, and the main illustrated embodiment having approximately 45% width will accommodate a wide range of configurations, as treated in detail herein. In circumstances requiring that the two folding trench side units 20 be set up as a square, with the wing wall folding units 22 at near right angles and the vertical wing frame members 5 in near contact, the wing wall folding units 22 can be provided with a width of up to approximately 49% of the width of the main wall folding unit 21, as shown, without interfering with the operation or the folding of the folding trench side units 20.

Figure 8:
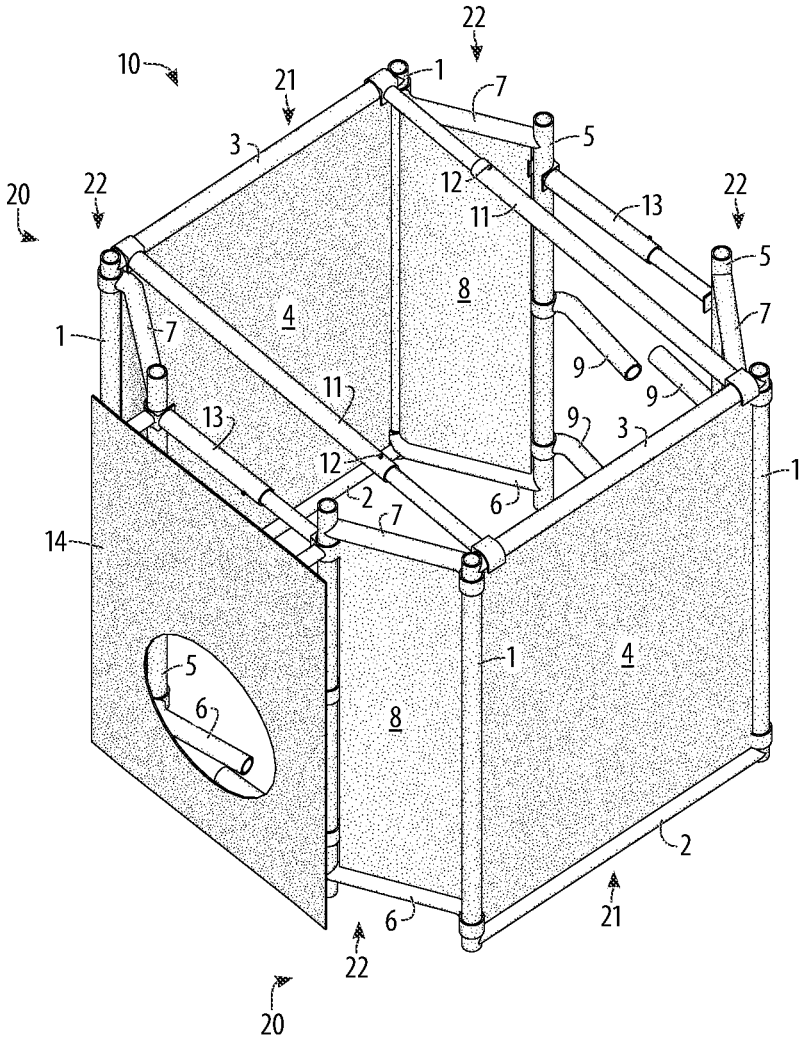
FIG. 8 is a perspective view of a folding embodiment of the pipe trench safety brace-barrier of the invention additionally showing adjustable main transverse members and supplemental barrier.

Referring to FIG. 8, both the folding embodiments and the non-folding embodiments of the pipe trench safety brace-barrier 10 can be supplemented with optional additional braces, barriers, fittings, or equipment such as the adjustable wing transverse members 13 and the supplemental barrier 14 illustrated. Where the frame members are made from standard pipe, tube, or other structural steel shapes, a variety of either standard or custom-made equipment can be securely attached as needed. As examples, the adjustable wing transverse members 13 can be used to securely fix the vertical wing frame members 5 of opposing trench side units 20 each to the other, or a supplemental barrier 13 such as the one shown can be used to more fully protect the area between the vertical wing frame members 5, which would usually be an area of open trench presenting very little cave-in or encroachment risk.

Figure 9:
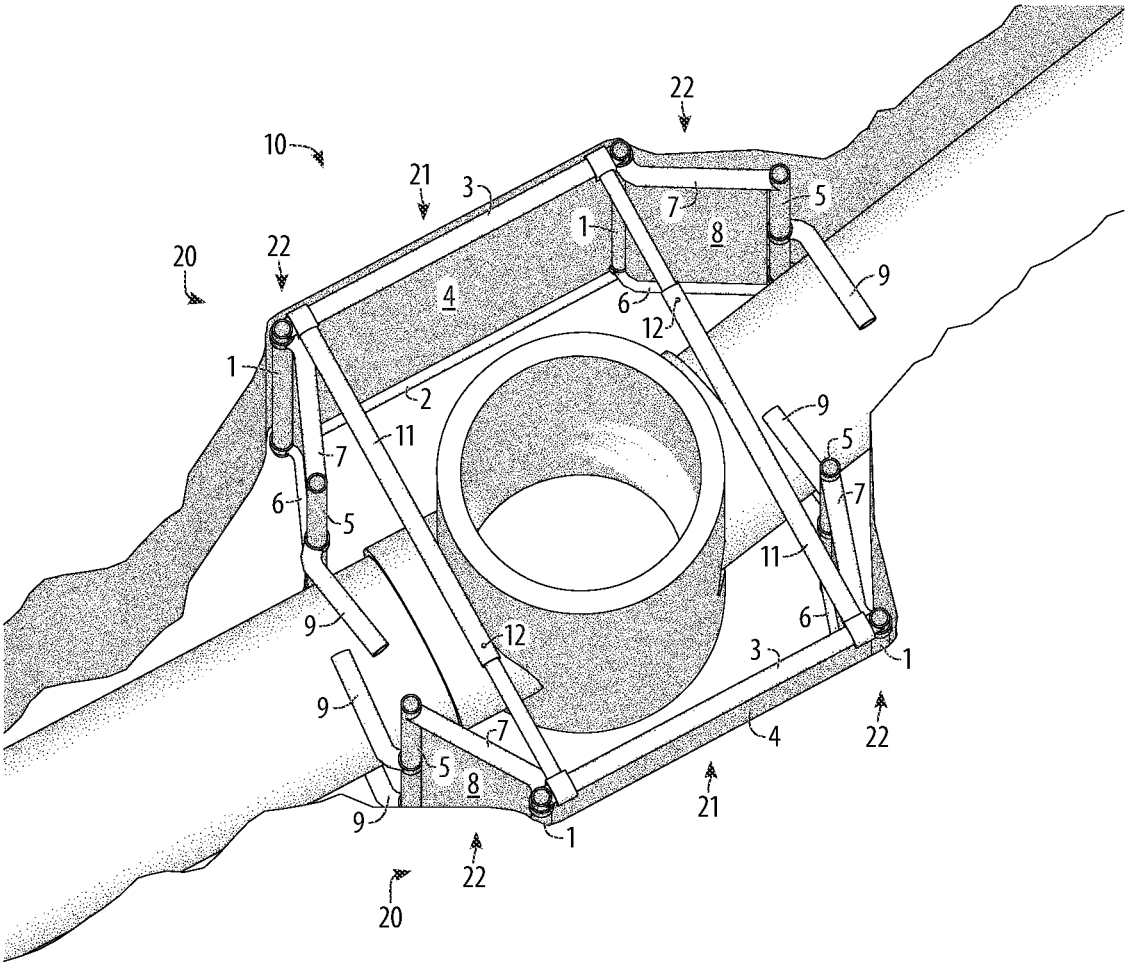
FIG. 9 is a perspective view of a folding embodiment of the pipe trench safety brace-barrier of the invention in use within a trench adjusted for a change of angle of the pipe.

Referring to FIG. 9, because each wing wall folding unit 22 of the folding embodiment can be independently placed at various angles to the main wall folding unit 21, the circumstances of a pipe entering and exiting the manhole at different angles, and the corresponding change of angle of the extending trench, can be accommodated by offsetting the location of the gap between opposing vertical wing frame members 5, as shown.

Figure 10:
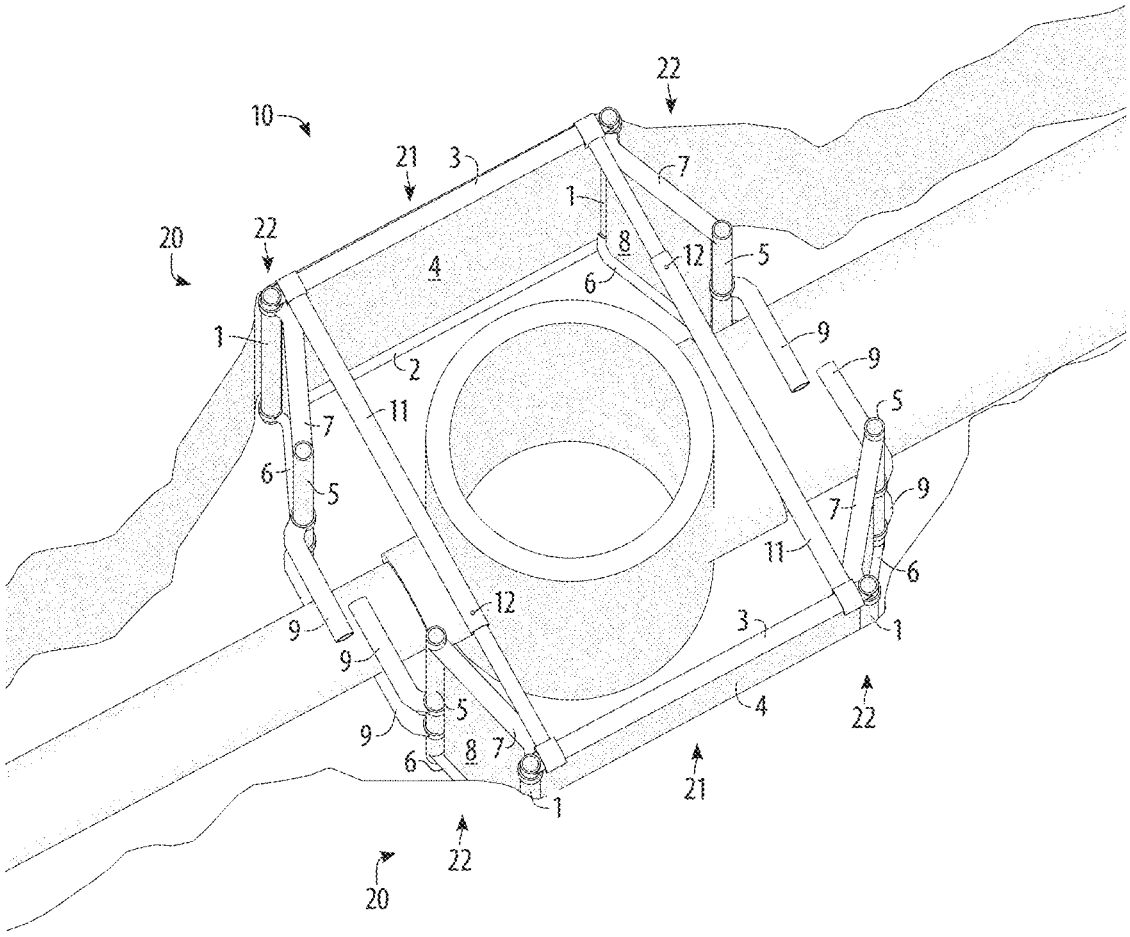
FIG. 10 is a perspective view of a folding embodiment of the pipe trench safety brace-barrier of the invention in use within a trench adjusted for a change of size of the pipe.

Referring to FIG. 10, for both the folding embodiment and the non-folding embodiment, because the adjustable wing extensions 9 are of sufficient length to meet and overlap in the gap between opposing vertical wing frame members 5, a small-diameter pipe can be supported and braced against downward or upward forces even where the vertical wing frame members 5 do not make contact to brace against lateral forces. Where such lateral bracing, or where a more complete barrier is needed, optional supplemental braces, barriers, fittings, or equipment can be used.

Figure 11:
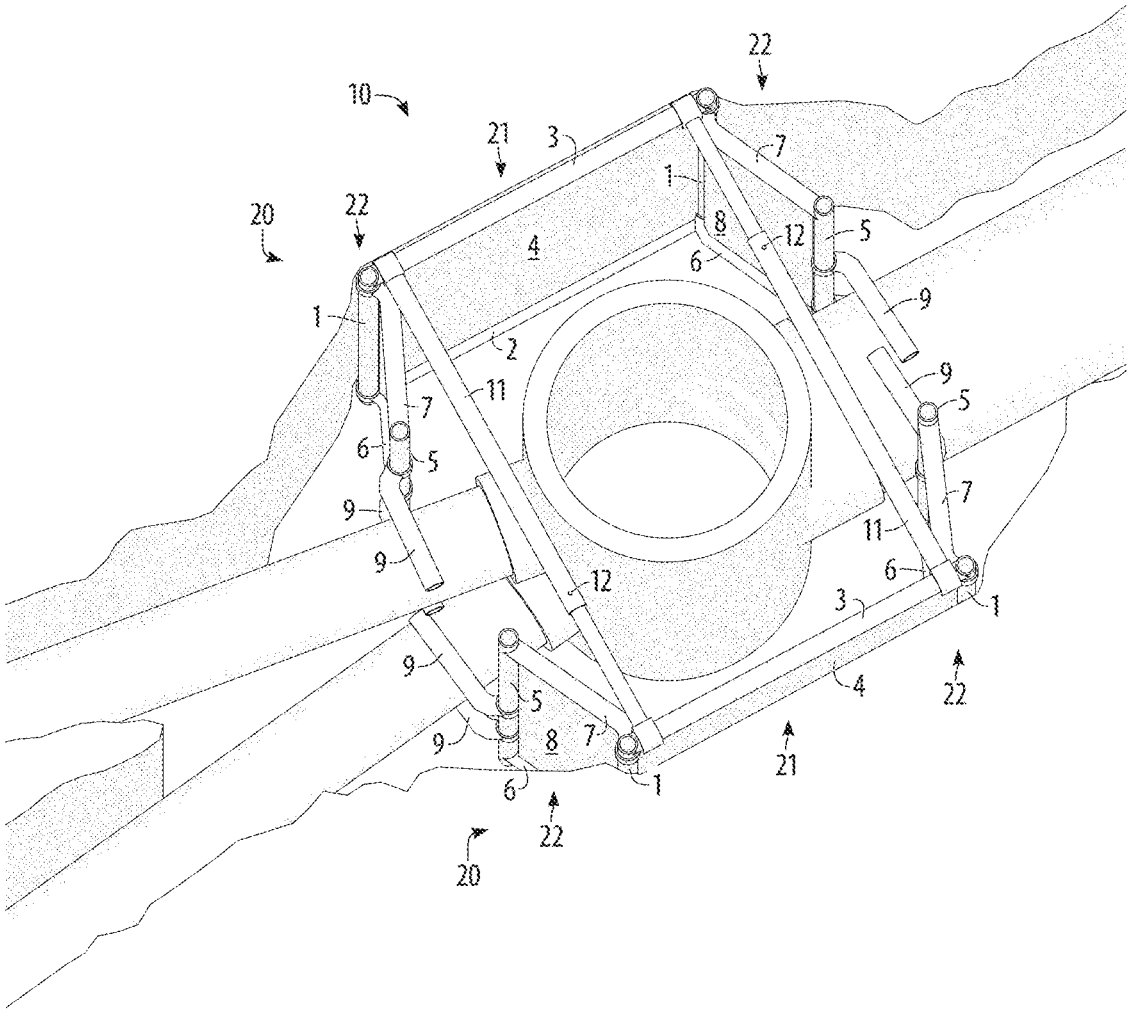
FIG. 11 is a perspective view of a folding embodiment of the pipe trench safety brace-barrier of the invention in use within a trench adjusted for two pipes entering one side of a manhole.

Referring to FIG. 11, for both the folding embodiment and the non-folding embodiment, the pipe trench safety brace-barrier 10 can be adjusted during installation and use to accommodate circumstances such as many different pipes in different trenches at different levels entering or exiting the manhole. In a similar way the pipe trench safety brace-barrier 10 can be adjusted to accommodate and allow the passage of other pipes, tubes, conduit, or cables which do not enter or exit the manhole but only pass through the workspace.

Figure 12:
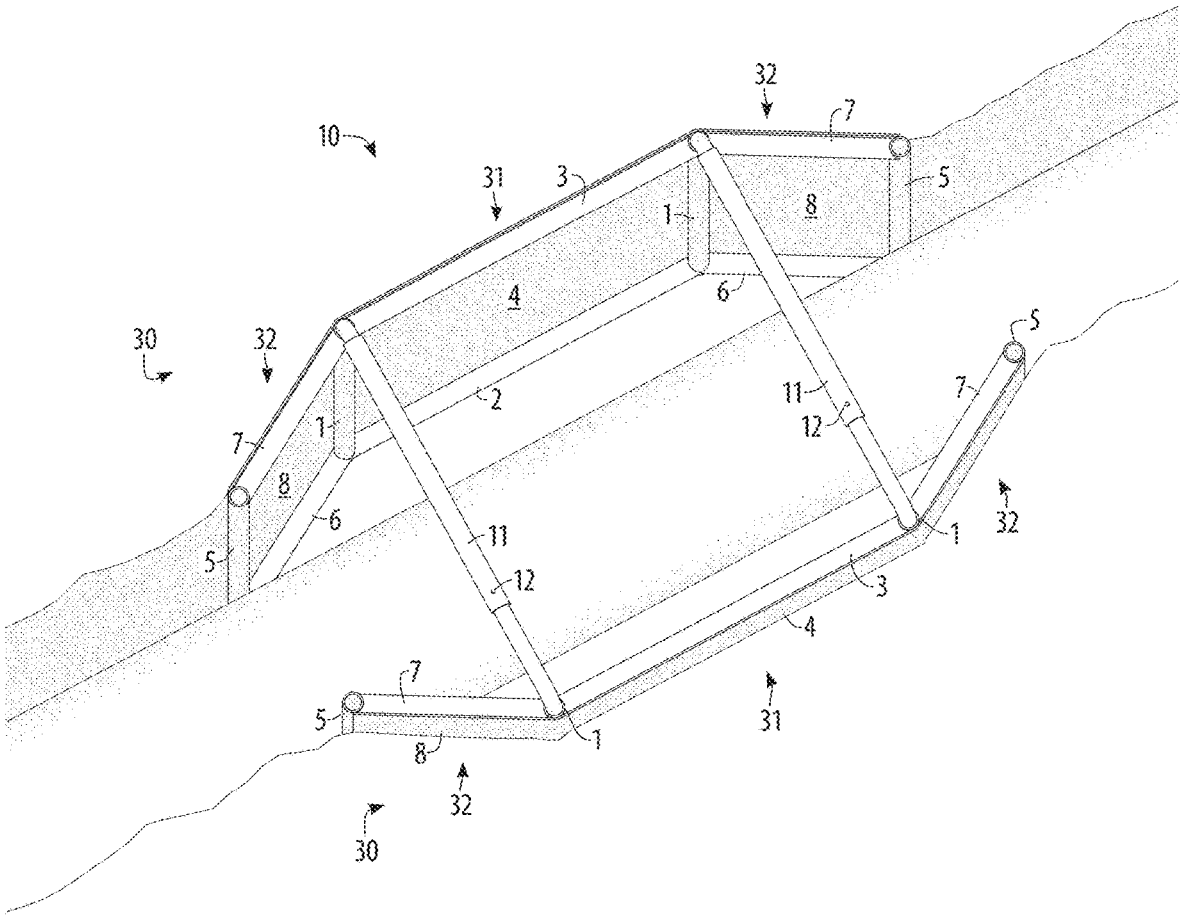
FIG. 12 is a perspective view of a non-folding embodiment of the pipe trench safety brace-barrier of the invention in use within a trench with a section of pipe.
Figure 13:
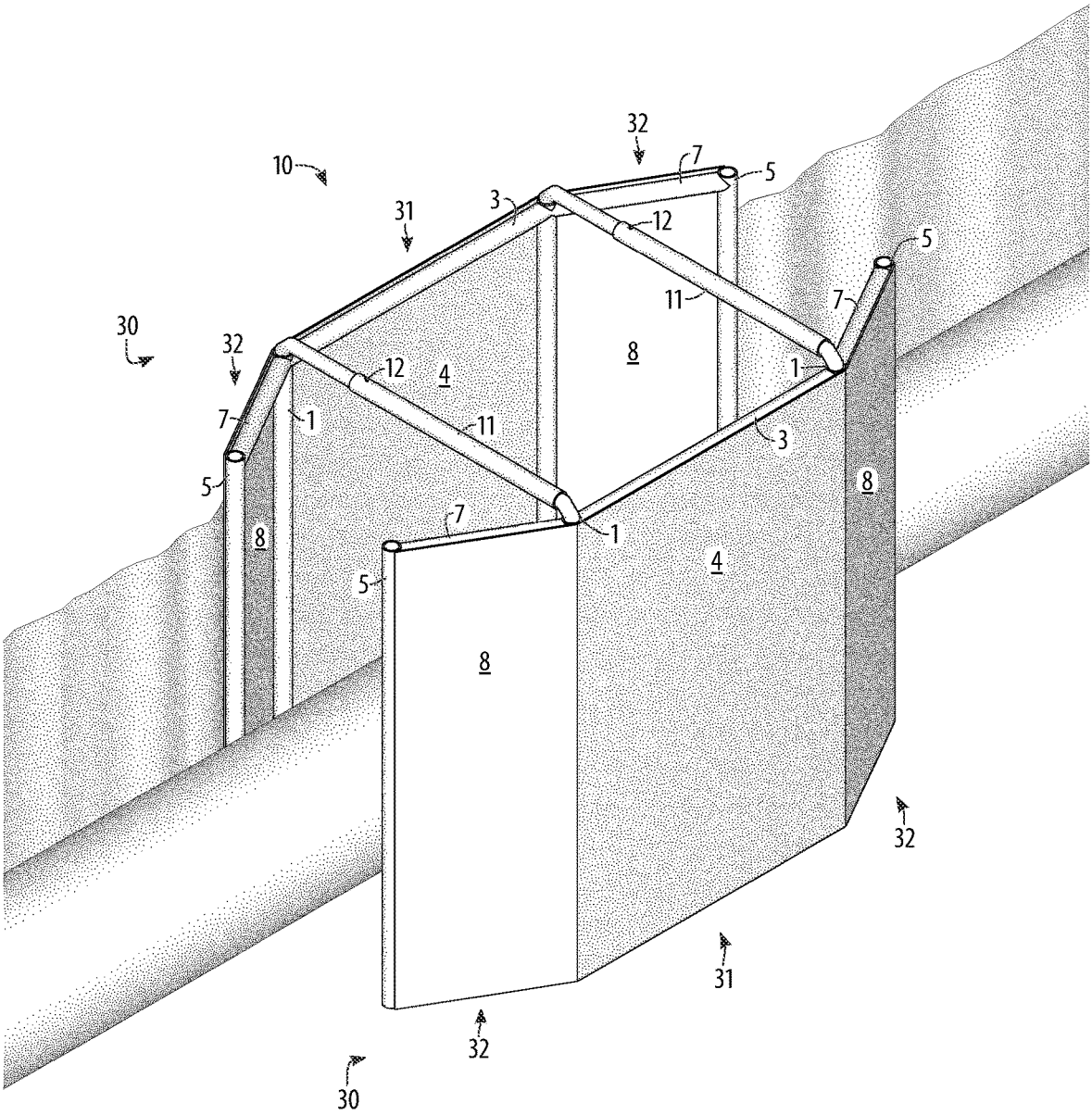
FIG. 13 is a perspective view of a non-folding embodiment of the pipe trench safety brace-barrier of the invention in use within a trench.

Referring to FIG. 12 and FIG. 13, the non-folding embodiment of the pipe trench safety brace-barrier 10 provides two non-folding trench side units 30 placed, in use, opposite each other and against the walls of the workspace section of the trench, as shown. Each non-folding trench side unit 30 provides a main wall non-folding unit 31 providing two main vertical frame members 1 running vertically from the bottom toward the top of the trench. Between the two main vertical frame members 1 are permanently horizontally mounted at the bottom a lower main frame member 2 and at the top an upper main frame member 3, forming a rectangle. A main barrier 4 is mounted securely to the main vertical frame members 1, lower frame member 2, and upper main frame member 3, forming a rectangular main wall non-folding unit 31 capable of blocking the movement of dirt or debris. Two wing wall non-folding units 32 are provided.

Each wing wall non-folding unit 22 is fixedly mounted to a different main vertical frame member 1 of the main wall non-folding unit 31 such that the wing wall folding unit 22 is held at a set angle. The set angle as illustrated is 30 degrees, which is appropriate for typical uses. Each wing wall non-folding unit 32 provides a lower wing frame member 6 and an upper wing frame member 7, both fixedly mounted to a main vertical frame member 1, and both running horizontally. A vertical wing frame member 5 is permanently mounted at the bottom to the lower wing frame member 6 and at the top to an upper wing frame member 7, forming a rectangle. A wing barrier 8 is mounted securely to the vertical wing frame member 5, lower wing frame member 6, and upper wing frame member 7, forming a rectangular wing wall non-folding unit 32 capable of blocking the movement of dirt or debris, set at an angle to the main wall non-folding unit 31.

Optionally, one or more adjustable wing extensions 9 are can be mounted to any vertical wing frame member 5 such that each adjustable wing extension 9 can be independently rotated about the vertical axis of the vertical wing frame member 5, can be independently moved up and down the vertical wing frame member 5, and can be securely temporarily fixed in position on the vertical wing frame member 5 by known means such as a clamp, screw, or toggle, as treated in detail above.

In use, the two non-folding trench side units 30 are placed opposite each other, at or near the walls of the workspace section of the trench. Each rectangular wing wall non-folding unit 32 is held at a set angle about its main vertical frame member 1 placing its vertical wing frame member 5 toward the pipe and toward the central area of the trench, bringing the vertical wing frame member 5 close to or in contact with the pipe. Optionally, the adjustable wing extensions 9 are rotated about and are moved up and down the vertical wing frame member 5 and are securely temporarily fixed in position on the vertical wing frame member 5. The adjustable wing extensions 9 are positioned to allow the entry of the pipe into the workspace, and preferably to both support the pipe in the proper position for joining to the manhole unit, and to prevent the pipe being moved out of position by forces exerted on the pipe outside of the workspace.

Maximum support of the pipe can be achieved when the vertical wing frame members 5 are in contact with the pipe, bracing against lateral movement, and the adjustable wing extensions 9 are in contact with opposite portions of the pipe, bracing against upward or downward movement.

At least one adjustable main transverse member 11 is securely removably mounted between both upper main frame members 3 to prevent any tilting of the upper portions of the non-folding trench side units 30 toward each other. At least one fastener 12, such as a bolt or a t-handled bolt, or a clamp, screw, or toggle, is provided for each adjustable main transverse member 11 to allow the adjusted length to be securely fixed during use and to be collapsed for storage and re-extended for subsequent use. The use of two adjustable main transverse members 11 is illustrated. Generally, the lowest portions of the non-folding trench side units 30 will be in contact with, and possibly slightly sunk into the ground at the bottom of the workspace, providing sufficient stability and resistance to movement. Where needed, the bottom portions of the main wall units 31 can also be braced with adjustable main transverse members 11 or by other methods such as driving stakes into the ground. Also, the wing wall non-folding units 32 provide additional bracing against tilting or movement of the non-folding trench side unit 30.

Figure 14:
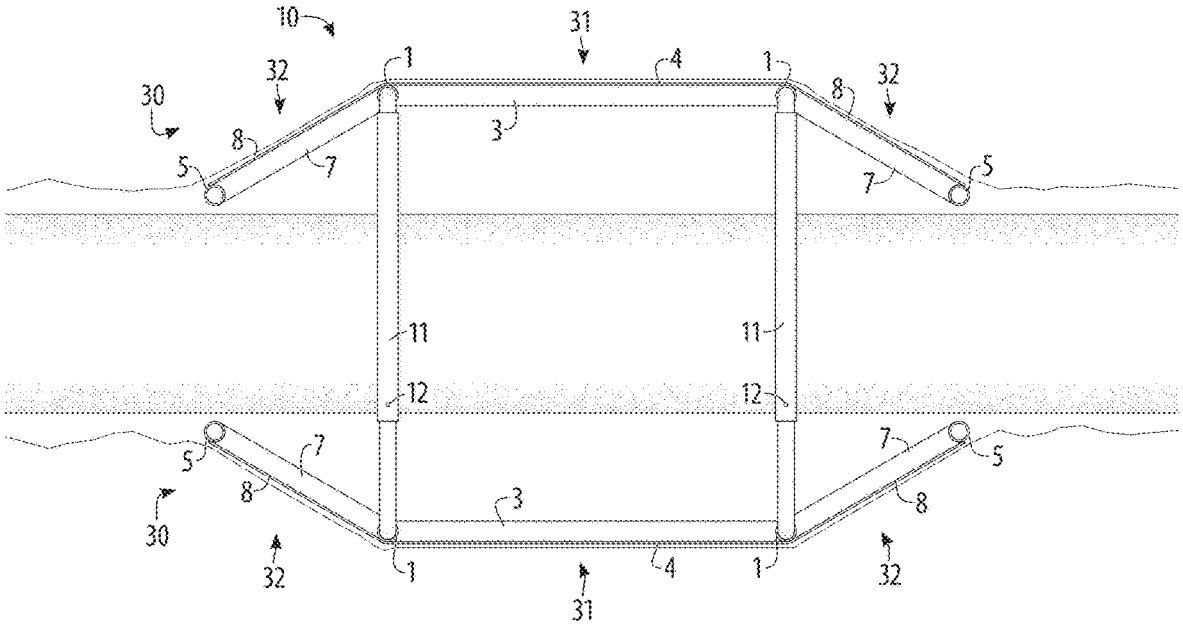
FIG. 14 is an overhead view of a non-folding embodiment of the pipe trench safety brace-barrier of the invention in use within a trench with a section of pipe in normal placement.
Figure 15:
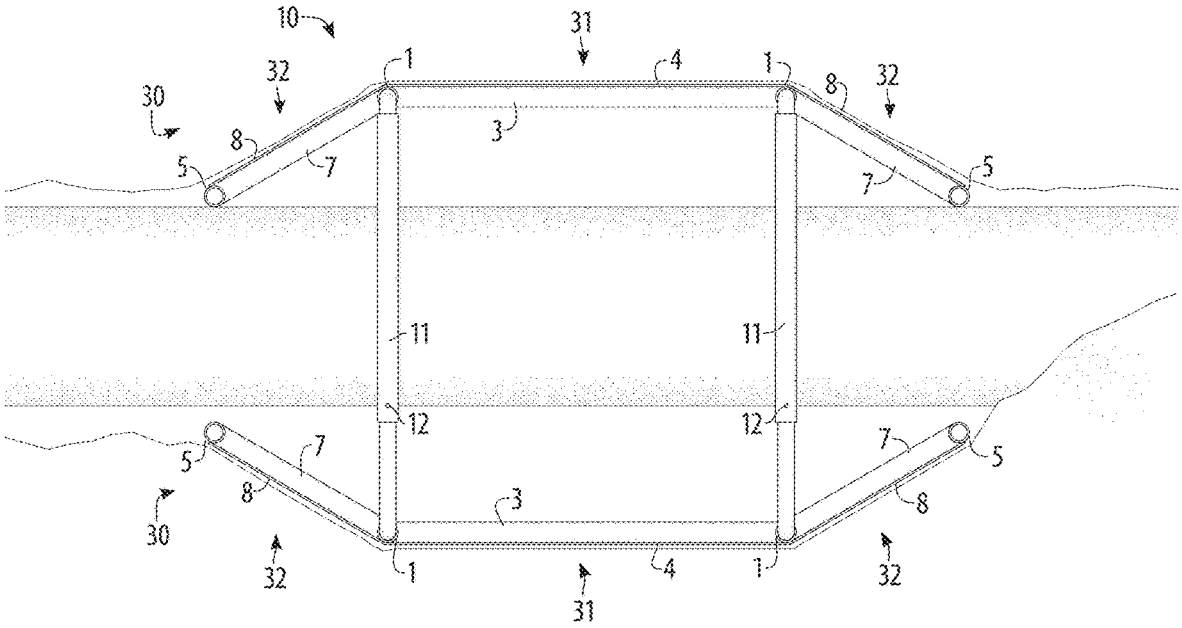
FIG. 15 is an overhead view of a non-folding embodiment of the pipe trench safety brace-barrier of the invention in use within a trench with a section of pipe displaced by a collapse of the trench outside the barrier.

Referring to FIG. 14 and FIG. 15, in use, the wing wall non-folding units 32 will be angled inward toward the middle of the trench and toward the pipe. On either side of the pipe, a safe protected workspace is created between the pipe and each main wall non-folding unit 31. If a force such as the cave-in illustrated acts to shift the pipe, the movement of the pipe will be stopped by the vertical wing frame members 5 at the ends of the relevant wing wall non-folding units 32, and will not further encroach into the safe protected workspace.

Figure 16:
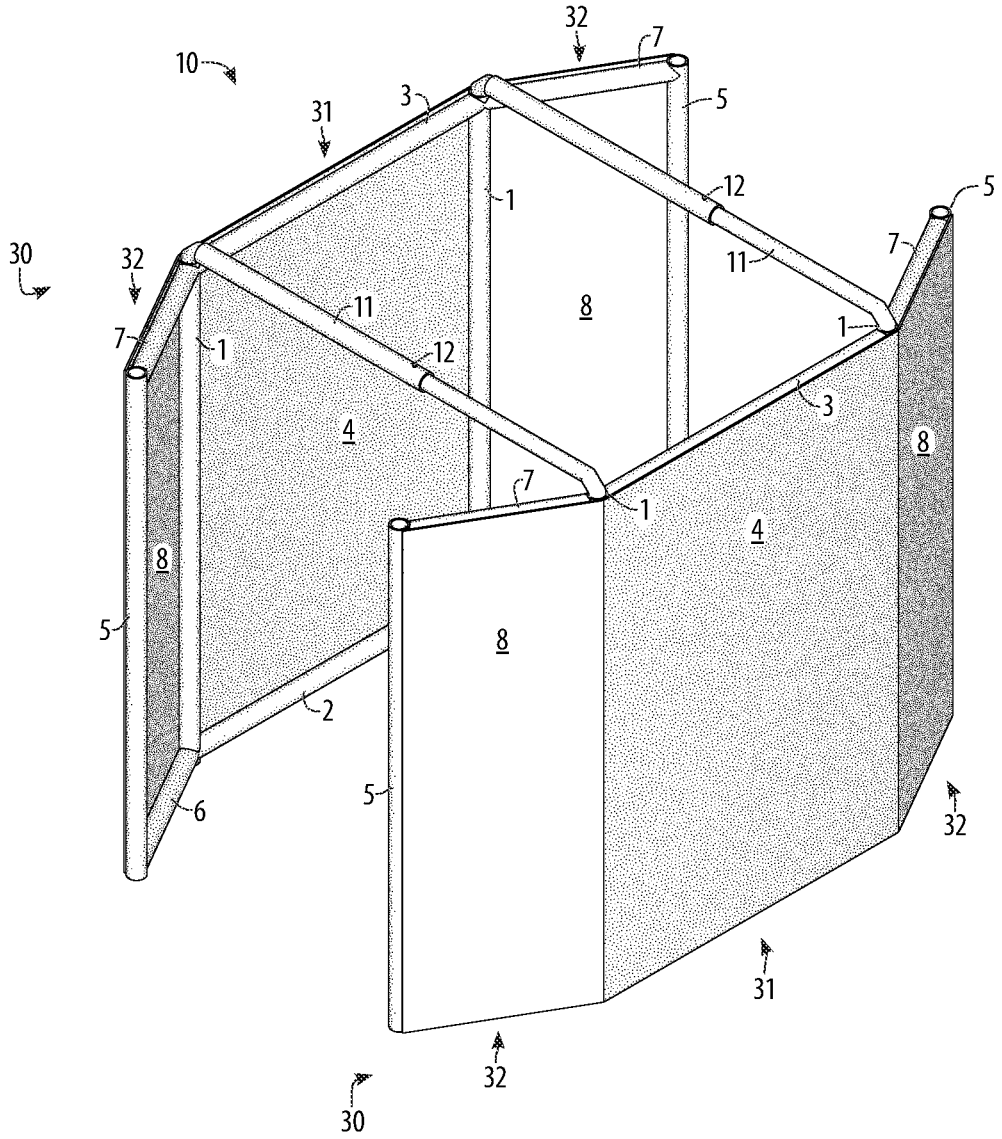
FIG. 16 is a perspective view of a non-folding embodiment of the pipe trench safety brace-barrier of the invention in a braced configuration for use.
Figure 17:
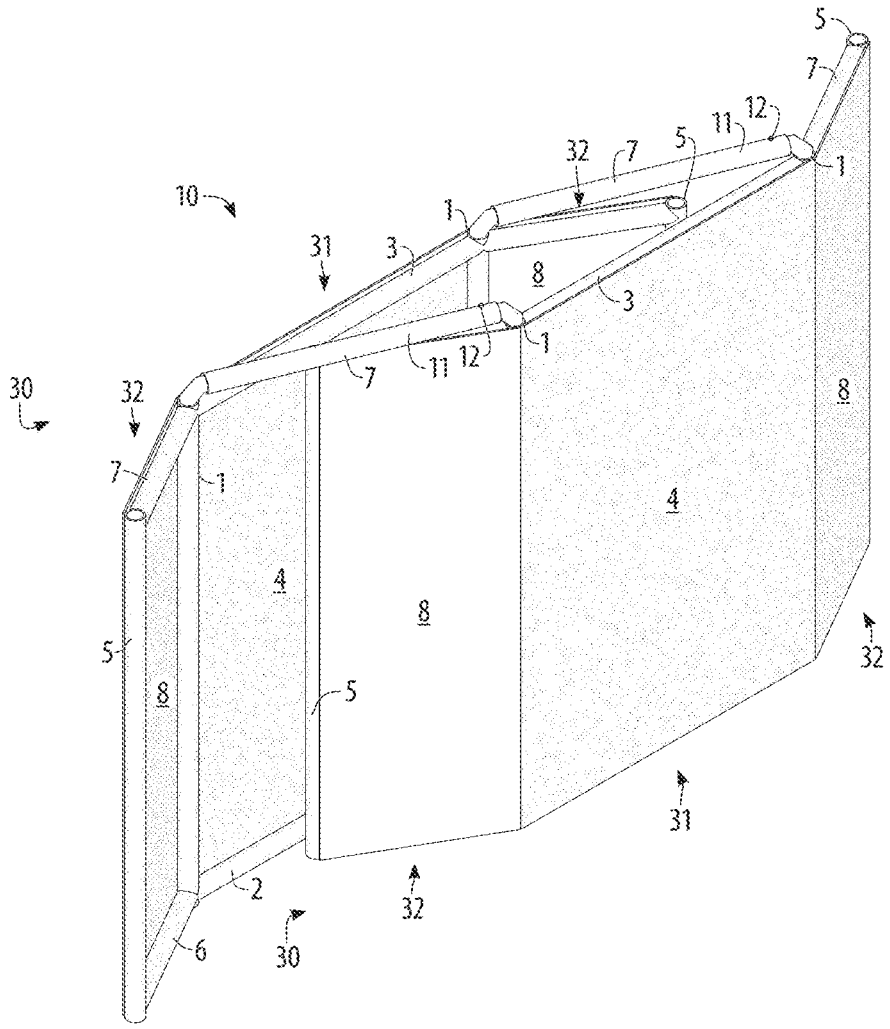
FIG. 17 is a perspective view of a non-folding embodiment of the pipe trench safety brace-barrier of the invention in a collapsed configuration for transport and storage.

Referring to FIG. 16 & FIG. 17, the non-folding embodiment of the pipe trench safety brace-barrier 10 can be braced and stabilized for use in a trench using adjustable main transverse members 11, as treated above. The adjustable main transverse members 11 can be rotatably mounted into the main vertical frame members 1 of the two non-folding trench side units 30, as illustrated. When the adjustable main transverse members 11 are rotatably mounted in that way, the two non-folding trench side units 30 can be collapsed together for transport and storage by sliding and bringing together the two non-folding trench side units 30 while rotating the adjustable main transverse members 11 about the vertical axes of the main vertical frame members 1 as shown. The fasteners 12 can be loosened to allow for adjustment and equalization of the length of the adjustable main transverse members 11 as needed.

Many other changes and modifications can be made in the system and method of the present invention without departing from the spirit thereof. We therefore pray that our rights to the present invention be limited only by the scope of the appended claims.

We claim:

1. A pipe trench safety brace-barrier system for use to form a protected workspace in a trench, the pipe trench safety brace-barrier system comprising:

(i) two folding trench side units, each folding trench side unit comprising:

(a) a main wall folding unit comprising:

(1) two main vertical frame members;

(2) a lower main frame member mounted horizontally joining said two main vertical frame members at the bottom;

(3) an upper main frame member mounted horizontally joining said two main vertical frame members at the top; and (4) a main barrier mounted to said vertical frame members, said lower main frame member, and said upper main frame member; and (b) two wing wall folding units rotatably mounted to said main vertical frame members, each wing wall unit comprising:

(1) a lower wing frame member rotatably horizontally mounted to a said main vertical frame member at the bottom;

(2) an upper wing frame member rotatably horizontally mounted to a said main vertical frame member at the top;

(3) a vertical wing frame member mounted at the bottom to said lower wing frame member and mounted at the top to said upper wing frame member; and (4) a wing barrier mounted to said vertical wing frame member, said lower wing frame member, and said upper wing frame member; and (ii) at least one adjustable main transverse member adapted to hold said folding trench side units apart from each other and against the wall of the trench.

2. The pipe trench safety brace-barrier system of claim 1, further comprising at least one adjustable wing extension adjustably and rotatably mounted to said vertical wing frame member.

3. The pipe trench safety brace-barrier system of claim 1, further comprising a supplemental barrier removably mounted upon said wing wall units.

4. The pipe trench safety brace-barrier system of claim 1, further comprising an adjustable wing transverse member removably mounted upon said wing wall folding units.

5. The pipe trench safety brace-barrier system of claim 1, where said folding trench side units are made of structural steel.

6. The pipe trench safety brace-barrier system of claim 1, where said at least one adjustable wing extension further comprises more than one adjustable wing extension.

7. The pipe trench safety brace-barrier system of claim 1, where said folding trench side unit is further adapted to being folded to a reduced size.

8. The pipe trench safety brace-barrier system of claim 1, where said wing wall folding unit has a width not greater than one-half the width of said main wall folding unit.

9. The pipe trench safety brace-barrier system of claim 1, where said wing wall folding unit has a width of 49 percent of the width of said main wall folding unit.

10. The pipe trench safety brace-barrier system of claim 1, where said wing wall folding unit has a width of 45 percent of the width of said main wall folding unit.

11. A pipe trench safety brace-barrier system for use to form a protected workspace in a trench, the pipe trench safety brace-barrier system comprising:

(i) two non-folding trench side units, each non-folding trench side unit comprising:

(a) a main wall non-folding unit comprising:

(1) two main vertical frame members;

(2) a lower main frame member mounted horizontally joining said two main vertical frame members at the bottom;

(3) an upper main frame member mounted horizontally joining said two main vertical frame members at the top; and (4) a main barrier mounted to said vertical frame members, said lower main frame member, and said upper main frame member; and (b) two wing wall non-folding units fixedly mounted to said main vertical frame members at a set angle, each wing wall unit comprising:

(1) a lower wing frame member fixedly horizontally mounted to a said main vertical frame member at the bottom;

(2) an upper wing frame member fixedly horizontally mounted to a said main vertical frame member at the top;

(3) a vertical wing frame member mounted at the bottom to said lower wing frame member and mounted at the top to said upper wing frame member; and (4) a wing barrier mounted to said vertical wing frame member, said lower wing frame member, and said upper wing frame member; and (ii) at least one adjustable main transverse member adapted to hold said non-folding trench side units apart from each other and against the wall of the trench.

12. The pipe trench safety brace-barrier system of claim 11, further comprising at least one adjustable wing extension adjustably and rotatably mounted to said vertical wing frame member.

13. The pipe trench safety brace-barrier system of claim 11, further comprising a supplemental barrier removably mounted upon said wing wall units.

14. The pipe trench safety brace-barrier system of claim 11, further comprising an adjustable wing transverse member removably mounted upon said wing wall non-folding units.

15. The pipe trench safety brace-barrier system of claim 11, where said folding trench side units are made of structural steel.

16. The pipe trench safety brace-barrier system of claim 11, where said at least one adjustable wing extension further comprises more than one adjustable wing extension.

17. The pipe trench safety brace-barrier system of claim 11, where said non-folding trench side units are further adapted to being collapsed together to a reduced size.

18. A pipe trench safety brace-barrier method comprising:

(i) digging a section of a trench as a workspace for installation of a pipe;

(ii) providing a pipe trench safety brace-barrier system comprising:

(a) two trench side units, each trench side unit comprising:

(1) a main wall unit having a first width, comprising:

(i) two main vertical frame members;

(ii) a lower main frame member mounted horizontally joining said two main vertical frame members at the bottom;

(iii) an upper main frame member mounted horizontally joining said two main vertical frame members at the top; and (iv) a main barrier mounted to said vertical frame members, said lower main frame member, and said upper main frame member; and (2) two wing wall units mounted to said main vertical frame members, each having a width not greater than said first width of said main wall unit, each wing wall unit comprising:

(i) a lower wing frame member horizontally mounted to a said main vertical frame member at the bottom;

(ii) an upper wing frame member horizontally mounted to a said main vertical frame member at the top;

(iii) a vertical wing frame member mounted at the bottom to said lower wing frame member and mounted at the top to said upper wing frame member; and (iv) a wing barrier mounted to said vertical wing frame member, said lower wing frame member, and said upper wing frame member; and (b) at least one adjustable main transverse member adapted to hold said trench side units apart from each other and against the wall of the trench;

(iii) transporting said trench side units to the workspace site;

(iv) placing two said trench side units into the trench workspace on opposing walls;

(v) mounting said adjustable main transverse members upon said trench side units to prevent tilting of said trench side units toward each other; and (vi) forming a protected workspace in the trench.

19. The pipe trench safety brace-barrier method of claim 18, further comprising providing at least one adjustable wing extension, and extending and adjusting said adjustable wing extensions to support and limit movement of the pipe.

* * * * *